United States Patent [19]

Colangelo

[11] Patent Number: 4,881,304

[45] Date of Patent: Nov. 21, 1989

[54] SELF-TIGHTENING PIVOTABLE GRIPPERS

[76] Inventor: Gabriel Colangelo, 35 Fearless Ave., Lynn, Mass. 01902

[21] Appl. No.: 240,509

[22] Filed: Sep. 6, 1988

[51] Int. Cl.[4] ..... A41F 1/00

[52] U.S. Cl. ..... 24/511; 24/501

[58] Field of Search ..... 24/511, 499, 500, 501, 24/489

[56] References Cited

U.S. PATENT DOCUMENTS

| | | | |
|---|---|---|---|
| 236,242 | 1/1881 | Newth | 24/511 |
| 1,103,455 | 7/1914 | Tufts | 24/511 |
| 2,920,365 | 1/1960 | Colangelo | 24/501 |
| 3,131,449 | 5/1964 | Iida | 24/334 |
| 3,349,453 | 10/1967 | Iida et al. | 24/489 |
| 3,456,262 | 7/1969 | Coon | 24/501 |

FOREIGN PATENT DOCUMENTS

| | | | |
|---|---|---|---|
| 0069934 | 9/1949 | Denmark | 24/501 |

*Primary Examiner*—Victor N. Sakran
*Attorney, Agent, or Firm*—Thomas C. Stover

[57] ABSTRACT

An improved self-tightening pivotable gripper is provided in a gripper having two pin members and an elongated leaf spring, in which the pin members each have a jaw and pivot arm with a pivot portion therebetween and in which the spring bends around and joins the pin members at their respective pivot portions, so that the jaws and pivot arms are positioned in opposed pivotable relationship. The improvement includes providing one of the pivot arms with a backer wall therein to support a section of the spring which extends outwardly from the pivot portion and proximate the backer wall in the inside thereof and then bends to cross diagonally and inwardly toward the pivot zone of the two pin members and extends proximate the other of the arms in a diagonal spring span, so as to contact such other arm when an outward pressure of e.g. a clothesline, is applied to the spring span so that the pivot arms are pushed apart more tightly, closing the jaws more tightly on a load e.g. a towel. In a further improvement, in some embodiments of the invention, the leaf spring after bending around a cross member of one pin member, then reverse bends around a cross member of the other pin member to hold the jaws thereof in close alignment.

9 Claims, 2 Drawing Sheets

SELF-TIGHTENING PIVOTABLE GRIPPERS

BACKGROUND OF THE INVENTION

1. Field of the Invention

This invention relates to grippers, particularly self-tightening pivotable grippers.

2. The Prior Art

Various grippers have been devised to hold objects e.g. on a line such as negatives in a dark room or clothes on a clothesline and the like. Particularly well known, for example, are spring clothespins which pivot around a spring member, which spring holds the jaws closed and pivot arms connected to such jaws open. Pressing the arms together opens the jaws and releasing the arms, closes the jaws with a grip that is determined by the strength of the pivot spring. The problem with such type of pivot pin is that the grip thereof may not be strong enough to hold certain objects e.g. wet towels or jackets to a clothesline, particularly on a windy day.

Previously a gripping device, including a clothespin, has been designed by me in which two pin members each have a jaw and a pivot arm and a pivot portion therebetween and a spring that bends around and joins the pin members at the respective pivot portions, so that jaws and pivot arms are positioned in opposed relationship, the spring having an extension which spans a substantial portion of the space between the pivot arms. See my patent, U.S. Pat. No. 2,920,365 (1960). The drawback with this gripping device was that a) the leaf spring did not extend into the jaw area of the device to steady the jaw portions in close alignment and b) that portion of the spring that extended upwardly into one of the arms (and then turned and extended in a span between the pivot arms of the gripping device) had no back wall support in one of the pivot arms to rest against and under the outward pressure of e.g. a clothesline, the spring span would be pulled out of the pin assembly or nearly so, imparing the effectiveness thereof.

Accordingly, there is a need and market for a gripper that has an improved spring configuration and improved spring reinforcement in a pin member thereof, so as to substantially overcome the above prior art shortcomings.

There has now been discovered an improved gripper in which the spring member thereof, which unites the gripping pins together at a pivot portion thereof, holds the gripper jaws together in close alignment and in which the extension of such spring is reinforced by one of the gripper pivot arms so as to resist disengagement of the spring span when outward pressure is applied thereto, e.g. on a clothesline, so that an improved gripper that is more sturdy and stable is provided in the present invention.

SUMMARY

Broadly the present invention provides a self-tightening pivotable gripper having two pin members and an elongated leaf spring, which pin members each have a jaw and pivot arm with a pivot portion therebetween, which spring bends around and joins the pin members at their respective pivot portions, so that the jaws and pivot arms are positioned in opposed pivotable relationship, the improvement comprising, providing one of the pivot arms with a backer wall therein for the spring section which extends outwardly from the pivot portion and proximate such backer wall on the inside thereof and thence bends to cross diagonally and inwardly toward the pivot zone of the two pin members, to extend to proximte the other of the arms in a diagonal spring span, so as to contact such other arm when an outward pressure is applied to the spring span so that the pivot arms are pushed apart more tightly, closing the jaws more tightly.

In some embodiments of the invention is a further improvement in that the spring thereof, after bending around a cross member of one pin member, then reverse bends around a cross member of the other pin member to hold the jaws thereof in close alignment.

DESCRIPTION

The invention will become more apparent from the following detailed Specification and drawings in which.

DESCRIPTION OF PREFERRED EMBODIMENT

Figure 1:
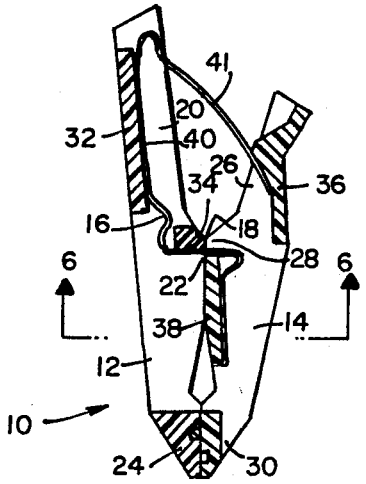
FIG. 1 is an elevation view of the self-tightening pivotable gripper of the present invention.
Figure 2:
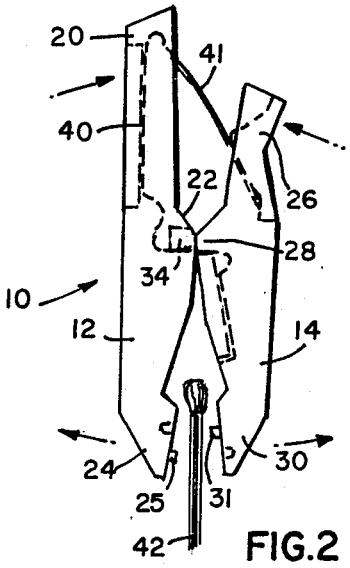
FIG. 2 is an elevation view of the gripper of FIG. 1 in a open position.
Figure 3:
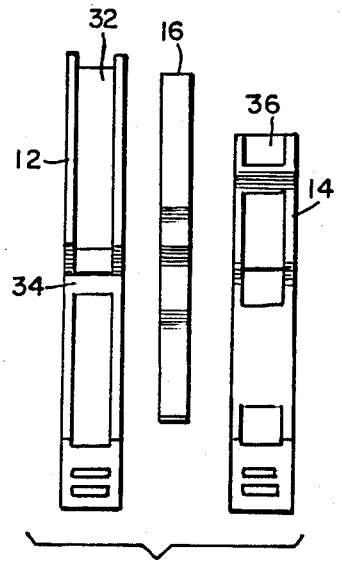
FIG. 3 is an elevation view of components of the gripper of FIG. 1.
Figure 4:
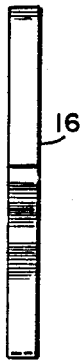
FIG. 4 is an elevation view of another component of the gripper of FIG. 1.
Figure 5:
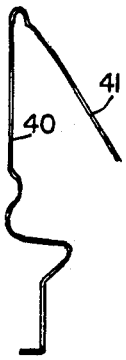
FIG. 5 is a side elevation view of the component of FIG. 4 taken on lines 5—5, looking in the direction of the arrows.
Figure 6:
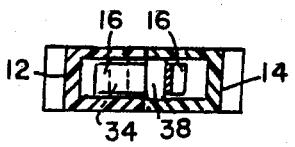
FIG. 6 is a sectional elevation view of the components of FIG. 1 taken on lines 6—6, looking in the direction of the arrows.

Referring now in more detail to the drawings, the self-tightening pivotable gripper or pivot pin 10 embodying the invention has two pin members 12 and 14 joined, by a leaf spring 16 at a pivot zone 18, as shown e.g. in FIGS. 1 and 2.

The pin member 12 has a pivot arm 20, pivot portion 22 and jaw 24, while the other pin member 14 likewise has a pivot arm 26, pivot portion 28 and jaw 30, as shown e.g. in FIG. 1. The pin 12 further has a backer wall 32 and a cross member 34, while the pin member 14 has a spring bearing surface 36 and a cross member 38, to position and guide the leaf spring 16, as shown in FIG. 1. That is, the leaf spring 16 bends around the cross member 34 of the pin 12 and then reverse bends around the cross member 38 of pin 14 to hold these two pin members together at their pivot portions (per FIG. 1), while the spring extension 40 bears against the backer wall 32 (of pivot arm 20) on the inside thereof, thence bends to cross diagonally and inwardly of the pivot zone 18 and extends (as spring span 41) proximate the bearing surface 36 of pin 14, which spring thus constrained, unites and interacts with the pivot members 12 and 14, as shown e.g. in FIGS. 1 and 2.

In operation, the pivotable pin of the invention is squeezed against the spring span 41, at the pivot arms 20 and 26, which pivots open the jaws 24 and 30 and a load 42 is inserted therein, as indicated in FIG. 2. The pressure on the pivot arm 20 and 26 is then released and the leaf spring extension 40 and span 41 push open such arms closing the jaws 24 and 30 onto the load 42, as shown or indicated in FIG. 7. The self-tightening pin of the invention is now brought to a clothesline 44, shown in phantom, which is pushed in against the spring span 41, which resiliently opens to admit such line 44 and then closes behind it against the bearing surface 36 of pin 14 and the line 44 then relatively moves upwardly in the diagonal spring extension (or span) 40 toward the peak thereof 46 as the weight of the loaded clothespin drops or slides down on the clothesline 44, as shown or indicated in FIG. 7.

The so-weighted pin 10 thus bears down on a clothesline 44, which relatively moves against the apex thereof 46 and the spring span 41 pushes against the bearing surface 36 of pin member 14, (causing the spring extension 40 to push against the backer wall 32 in pin member 12, pushing the pivot arms 20 and 26 further apart and) closing the jaws 24 and 30 of such pin more tightly as the load 42 increases, to provide the self-tightening pivotable gripper of the present invention.

Figure 7:
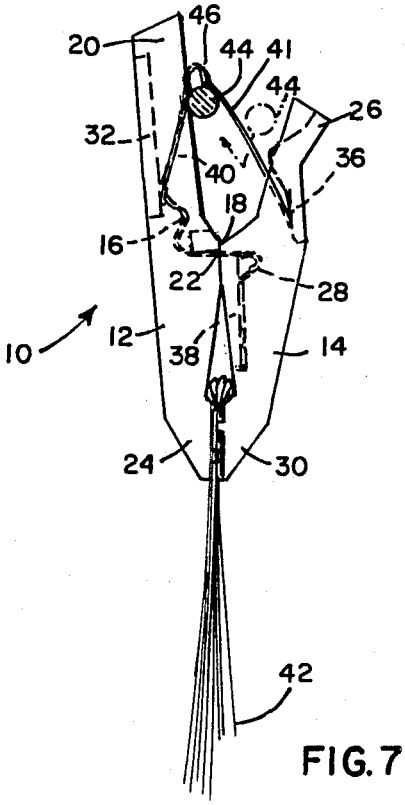
FIG. 7 is an elevation view of the self-tightening pivotable gripper embodying the invention under load.

In a further improvement of the self-tightening pivotable gripper of the invention, the spring extension 44 is desirably bent into a crimp or extended narrow apex e.g. apex 46, as shown in FIG. 7, which is of a narrower opening than the diameter of the clothesline to prevent the clothesline from entering such apex completely and "topping out" i.e. to prevent distortion of the spring extension and lessening of the outward pressure against the pivot arms and thus the grip of the self-tightening pivotable gripper of the invention. Thus, the elongated spring extension apex of the invention maintains the spring tension to close the gripper jaws 24 and 13 ever more tightly with increasing loads by being thus configured.

Further, the jaws 24 and 30 of the gripper of the invention have irregular surfaces e.g. a projection 25 and a mating groove 31, to provide a surer, nonslip grip on a load e.g. as shown or indicated in FIGS. 2 and 1.

Thus, a) the backer wall 32, b) the bend and reverse bend of the spring 16 around the two cross members of the respective pins 12 and 14 for a double uniting spring action and nonslip jaws (relative to each other) and c) the crimped apex spring extenions 46 are important improvements to the self-tightening pivotable gripper embodying the present invention, which results in a nonslip pin which self tightens with increasing loads applied thereto.

Further, the improved gripper of the present invention, as with its predecessor, has the advantage of being openable (by sqeezing together the pivot arms 20 and 26 against a spring span 41) to release its load e.g. a towel, while remaining attached to the clothesline, which can remain inside the spring span 41. Note that one pivot arm is shorter than the other for ease of slipping a clothesline inside of and out of such spring span 41 e.g. as indicated in FIG. 7 and also for squeezing the two pivot arms together to open the gripper jaws e.g. jaws 24 and 30 as indicated in FIG. 2.

As noted above, the manner in which the spring 16 of the invention wraps around the cross member 34 of one pin member and then in a reverse bend wraps around the cross member 38 of the other pin member, e.g. in an "S" shape, more positively secures the two pin halves pivotably together and reduces side slippage (i.e. maintains alignment) therebetween. The invention thus provides an improved bending configuration over the predecessor gripper in which the spring wraps around cross members of the gripper halves in a U configuration.

The pin members can be made of various materials e.g. wood, plastic, metal and the like and preferably are of plastic.

The jaws of such pin members can be smooth but are of desirably irregular surface for a more secure grip therebetween.

The spring that unites the pin members can be a leaf spring of various desired bends provided it bends around cross members of the respective pin members. Such leaf spring is preferably of metal e.g. steel. The spring extension of such spring need not have a crimp at the apex thereof within the scope of the invention, but preferably does have such crimp for improved spring tension under heavy loads as indicated above.

One of the pivot arms has bearing surface 36 while the other lever arm has a backer wall 32, which pivot arms are pushed further apart by application of outward pressure to the spring span 41 on such bearing surfaces which increases the self-tightening of the gripper of the invention with increasing loads as described above.

What is claimed is:

1. A self-tightening pivotable gripper having two pin members and an elongated leaf spring, which pin members each have a jaw and pivot arm with a pivot portion therebetween, which spring bends around and joins said pin members at their respective pivot portions, so that said jaws and pivot arms are positioned in opposed pivotable relationship, the improvements comprising, (a) bending said spring around said pivot portions with a reverse curve to hold said pin members in secure pivotable alignment relative to each other, (b) with one end of said spring working against a bearing surface of a pin member on one side of said pivot portions and the other end of said spring working against the same pin member on the other side of said pivot portions and (c) providing one of said pivot arms with a backer wall therein for a spring section which extends outwardly from said pivot portions and proximate said backer wall on the inside thereof and thence bends to cross diagonally and inwardly toward the pivot zone of said two pin members, to extend to proximate the other of said arms in a diagonal spring span, so as to contact such other arm when an outward pressure is applied to said spring span so that said pivot arms are pushed apart more widely, closing said jaws more tightly.

2. The self-tightening pivotable gripper of claim 1 which serves as a clothespin.

3. The self-tightening pivotable gripper of claim 1 wherein said spring span opens inwardly when pushed against by a clothesline in the inward direction to admit said clothesline into said enclosure, but which spring span pushes against the arms of said gripper when pushed by said clothesline in an outward direction to push said arms outwardly and more tightly close said jaws, such that the greater the weight applied to the jaws of said gripper, the more said clothesline pushes outwardly against said spring span causing the jaws to grip tighter on an object held between.

4. The self-tightening pivotable grippers of claim 3, wherein at least one of said jaws has an irregular surface for better gripping of an article therebetween.

5. The self-tightening pivotable gripper of claim 3 wherein said spring span has a crimp or acute bend at the outer beginning portion of the span thereof to prevent a clothesline or other support member from topping out against such spring to impede the tightening action of said jaws.

6. The self-tightening pivotable gripper of claim 1, wherein said spring performs a double duty, (a) holds said pin members together in secure pivotable alignment and (b) the spring span portion thereof pushes against the arms of said gripper, in response to an upward or outward pressure against said span to push said arms apart and more tightly close said jaws in proportion to increasing loads applied to said jaws.

7. The self-tightening pivotable gripper of claim 1, wherein at least one of said jaws has an irregular surface for better gripping of an article therebetween.

8. The self-tightening pivotable gripper of claim 1, wherein said spring bends around a cross member of one pin member and then reverse bends around a cross member of the other pin member, to hold said pin member pivotably together in secure alignment.

9. The self-tightening pivotable gripper of claim 1, wherein said spring bends around a cross member of one pin member and then reverse bends around a cross member of the other pin member to hold said pin members pivotably together in secure alignment, after which said spring extends along the inside of said backer wall of said pivot arm and thence bends acutely backward in a crimped apex, to extend diagonally across to the other of said pivot arms to define said spring span.

* * * * *